US006298704B1

(12) United States Patent
Hoth, III

(10) Patent No.: US 6,298,704 B1
(45) Date of Patent: Oct. 9, 2001

(54) PORTABLE BENDING APPARATUS HAVING TRANSAXIAL WORKPIECE LOADING

(75) Inventor: George J. Hoth, III, Glenview, IL (US)

(73) Assignee: Juno Manufacturing, Inc., Des Plaines, IL (US)

( * ) Notice: Subject to any disclaimer, the term of this patent is extended or adjusted under 35 U.S.C. 154(b) by 0 days.

(21) Appl. No.: 09/583,461

(22) Filed: May 31, 2000

(51) Int. Cl.[7] ..... B21D 5/08
(52) U.S. Cl. ..... 72/175; 72/173
(58) Field of Search ..... 72/173–175, 170

(56) References Cited

U.S. PATENT DOCUMENTS

| | | | | |
|---|---|---|---|---|
| 1,199,715 | * | 9/1916 | Schmidt | 72/173 |
| 1,435,041 | * | 11/1922 | Zimmer | 72/173 |
| 1,930,562 | * | 10/1933 | Krueger | 72/174 |
| 2,759,514 | * | 8/1956 | Knost | 72/173 |
| 2,832,395 | * | 4/1958 | Fisher | 72/175 |
| 3,420,080 | * | 1/1969 | Supina | 72/173 |
| 3,430,474 | * | 3/1969 | Mann | 72/173 |
| 5,431,035 | * | 7/1995 | Sheen | 72/173 |

FOREIGN PATENT DOCUMENTS

| | | | | |
|---|---|---|---|---|
| 602214 | * | 7/1978 | (CH) | 72/175 |
| 456268 | * | 8/1913 | (FR) | 72/173 |
| 682331 | * | 11/1952 | (GB) | 72/173 |

OTHER PUBLICATIONS

Prima Lighting, Inc., Chandelier Kit Installation.
Wheelwright Equipment Photos, Jan. 11, 2000.
Rolls, Brakes, Shears & Pittsburgh Lock Former.
Central Machinery 12" Shear, Press Brake, & Slip Roll.
Roper Whitney of Rockford, Inc., Aug. 24, 1999.

* cited by examiner

*Primary Examiner*—Daniel C. Crane
(74) *Attorney, Agent, or Firm*—Anthony S. Zummer

(57) ABSTRACT

A portable workpiece bending apparatus selectively bends an elongated workpiece at selected portions of the workpiece along its length. The apparatus allows transaxial loading and unloading of the workpiece. The apparatus includes a frame. Three rollers are rotatably mounted on the frame. Each of the rollers is engageable with a workpiece, while the workpiece moves along its length to bend the workpiece as it moves along its length. An actuator is connected to one of the rollers for re-positioning that one roller relative to the other two rollers to allow the roller to be disposed from an operative position engageable with the workpiece to a spaced apart position from the other two rollers. Positioning of the one roller to the spaced apart position allows the workpiece to be positioned for engagement with the rollers for bending by moving the workpiece transverse to its direction of movement.

1 Claim, 10 Drawing Sheets

PORTABLE BENDING APPARATUS HAVING TRANSAXIAL WORKPIECE LOADING

BACKGROUND OF THE INVENTION

Bending machines, which are used to bend metal strips and sheets, typically load the machine in a direction which is generally perpendicular to the axis of rotation of rollers which engage the workpiece. The loading of a workpiece is done axially along the direction of movement of the workpiece as it passes through the bending machine. The bending machines typically are heavy appliances to cause the workpiece to bend. In light of the axial loading of the workpiece, along the axis of movement of the workpiece through the machine, the bending of the workpiece is done only in one direction so that it is difficult to have several bends in different directions and different amounts.

In certain applications, the workpiece is not thick nor very wide, such as, a part of a lighting system. It is desirable to form the workpiece at the location where the workpiece will be used. Such a application is one where the workpiece is part of a lighting system, and it is desired to form the workpiece with several curves. The workpiece may be formed around one of more corners. In some applications, a bend may be made for a particular purpose, such as, a specific location of a portion of the lighting system. To this end, it is desirable to provide a highly portable bending apparatus which may be transported to an installation site. The bending apparatus must be easily adjusted and easily operated in order to have appropriate bends made in the workpiece. Furthermore, it is desirable to exercise close control of the bending of the workpiece in order to have the proper bend of the workpiece for the given application.

SUMMARY OF THE INVENTION

The present invention is a portable workpiece bending apparatus for selectively bending an elongated workpiece at selected portions of the workpiece along its length. The bending of the workpiece may be done in either direction by allowing loading and unloading of the workpiece transaxially to the direction of movement of the workpiece through the bending apparatus. The apparatus includes a frame. Three rollers are rotatably mounted on the frame. Each of the rollers, when in an operative position, is adapted to engage a workpiece. The workpiece moves along its length through the apparatus to be bent selectively as it moves along its length. An actuator is connected to one of the rollers for selectively positioning that one roller relative to the other two rollers to allow the one roller to be disposed from an operative position engageable with the workpiece to a spaced apart position from the other two rollers and not in engagement with the workpiece. Positioning of the one roller in the spaced apart position allows the workpiece to be positioned for engagement with the rollers for bending by moving the workpiece transverse to its direction of movement when the workpiece is in operative engagement with the three rollers.

DETAILED DESCRIPTION OF THE INVENTION

Figure 1:
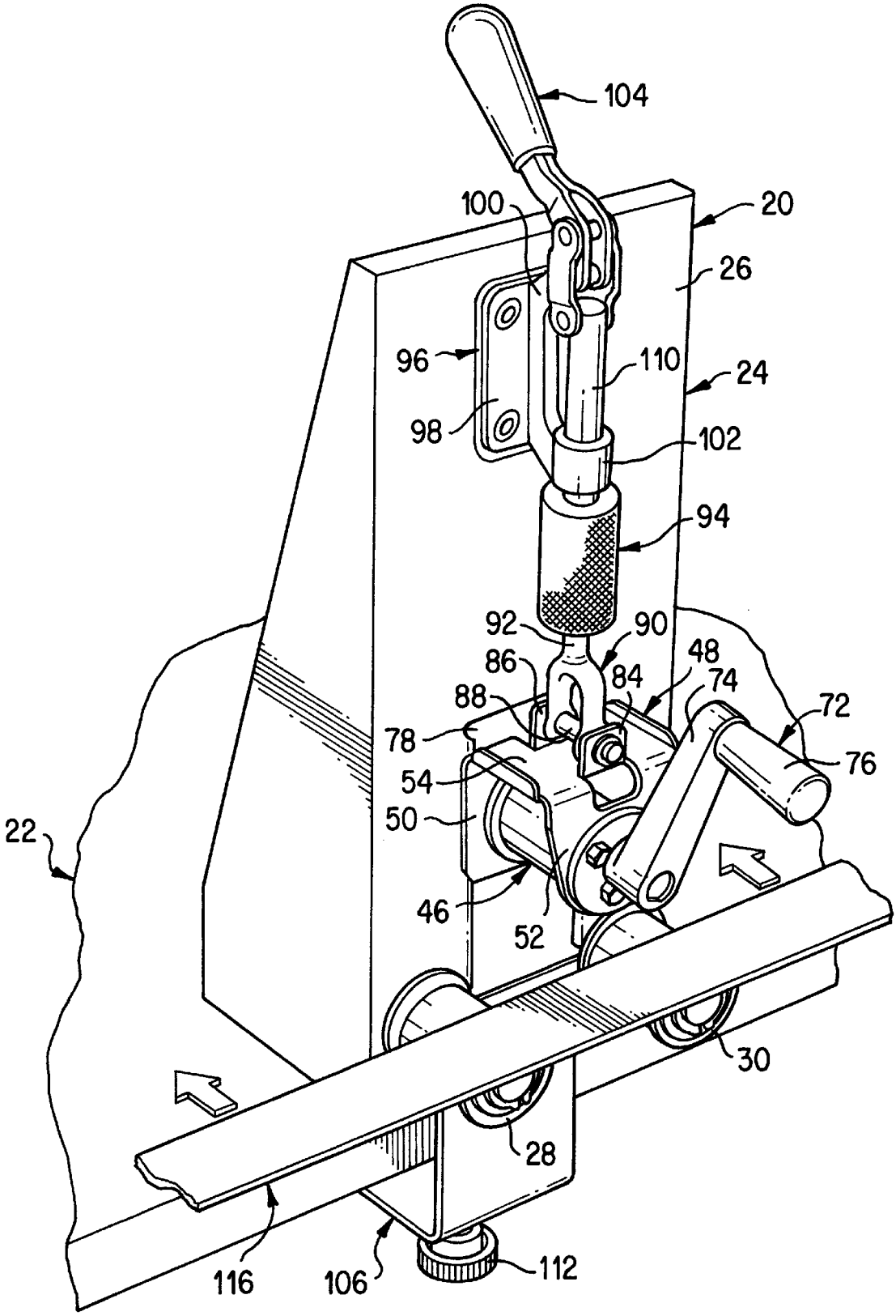
FIG. 1 is a perspective view of a portable workpiece bending apparatus for selectively bending an elongated workpiece showing a workpiece being loaded for engagement with three rollers while one of the rollers is positioned in a position away from the other two rollers.
Figure 2:
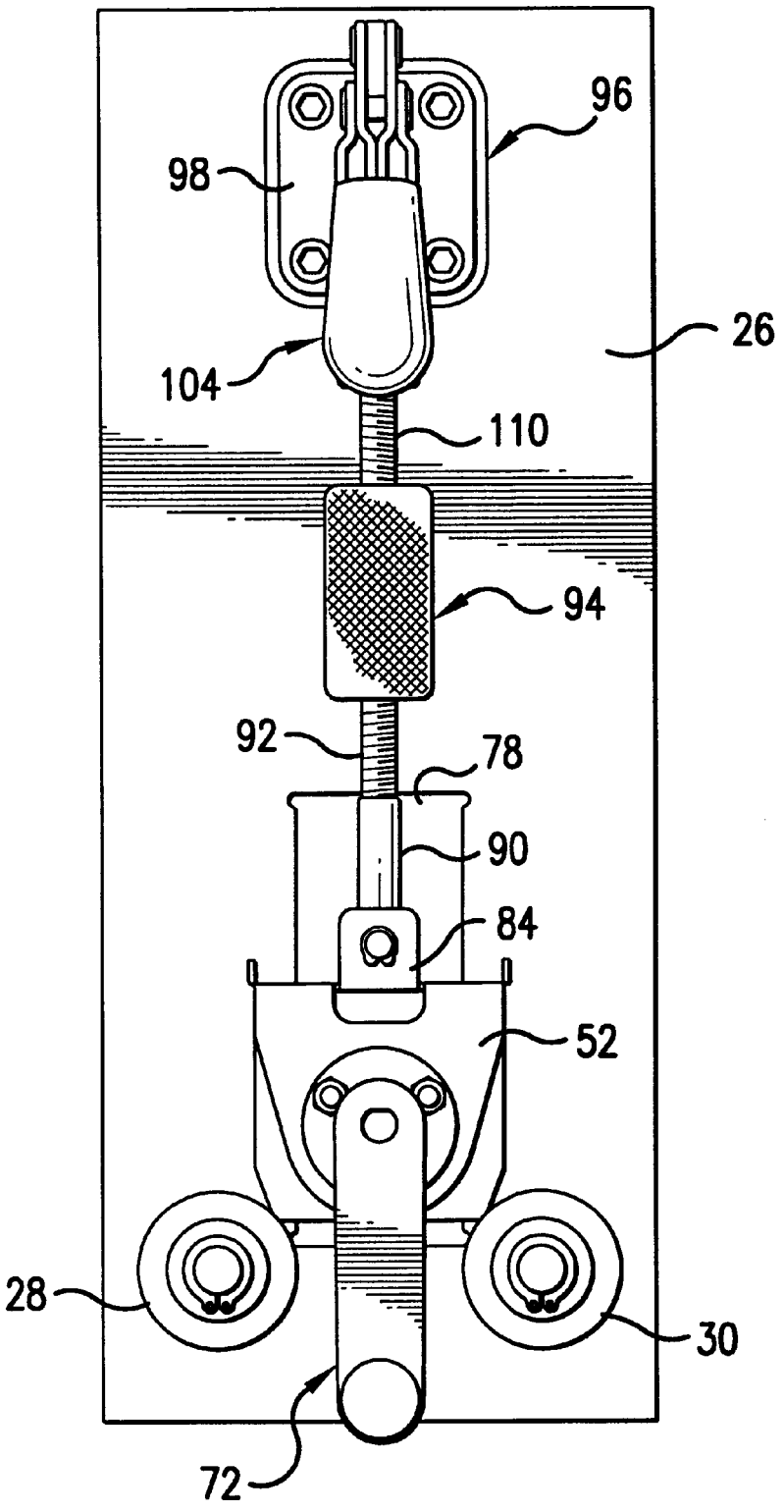
FIG. 2 is a front elevational view of a portion of the bending apparatus of FIG. 1 showing a movable roller in an operative engagement with the other two rollers.
Figure 3:
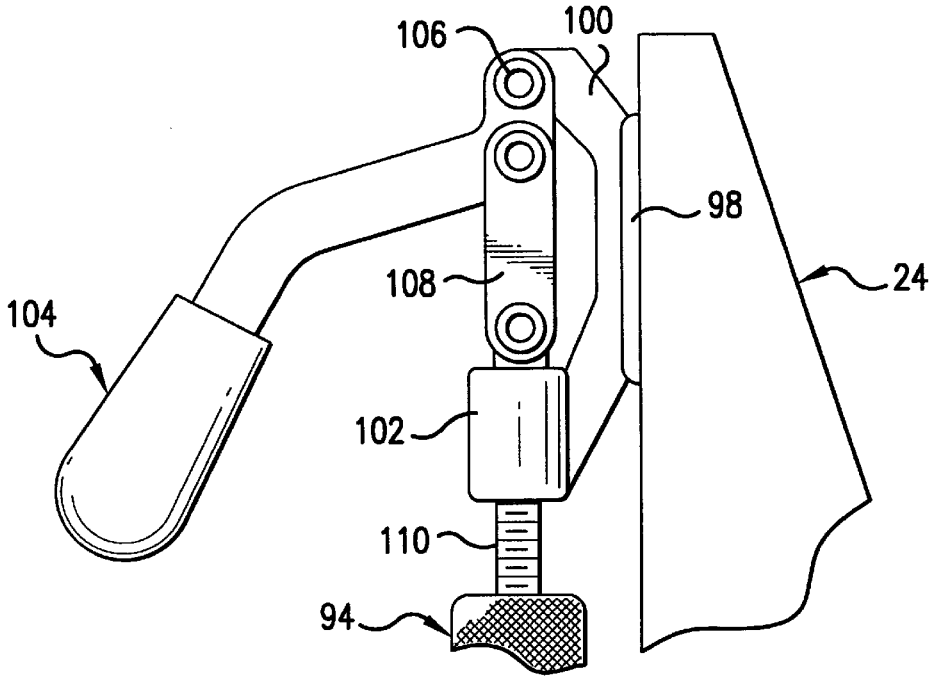
FIG. 3 is a side elevational view of a toggle apparatus of the bending apparatus of FIG. 1.
Figure 4:
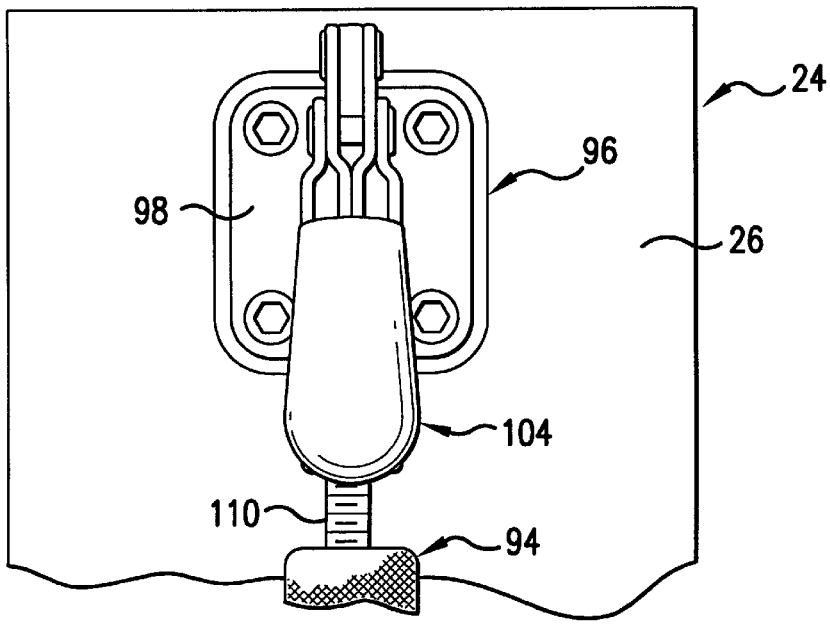
FIG. 4 is a front elevational view of the toggle apparatus of FIG. 3 with the handle in an operative position.
Figure 5:
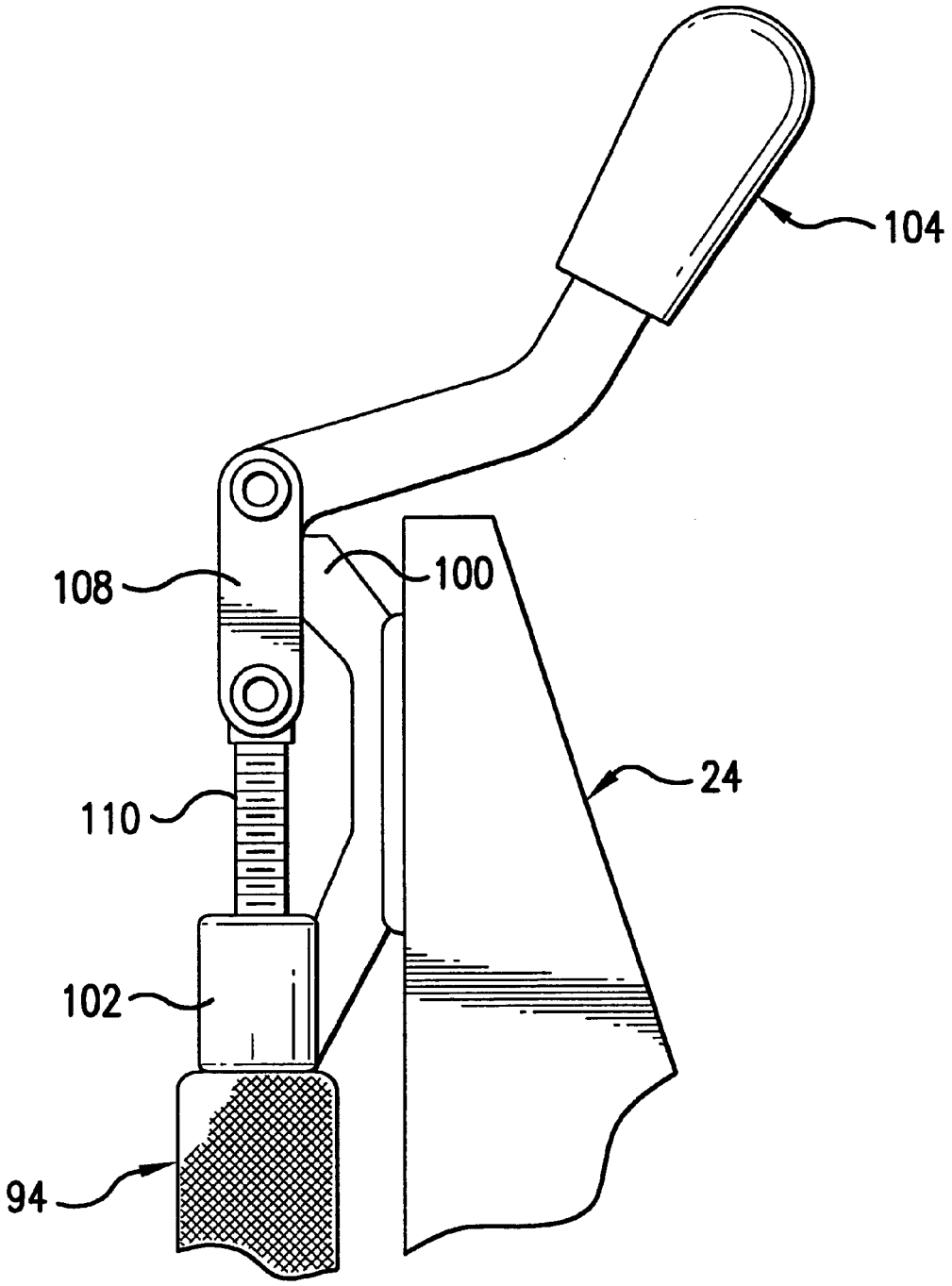
FIG. 5 is a side elevational view similar to FIG. 3, but showing the handle in a raised position.
Figure 6:
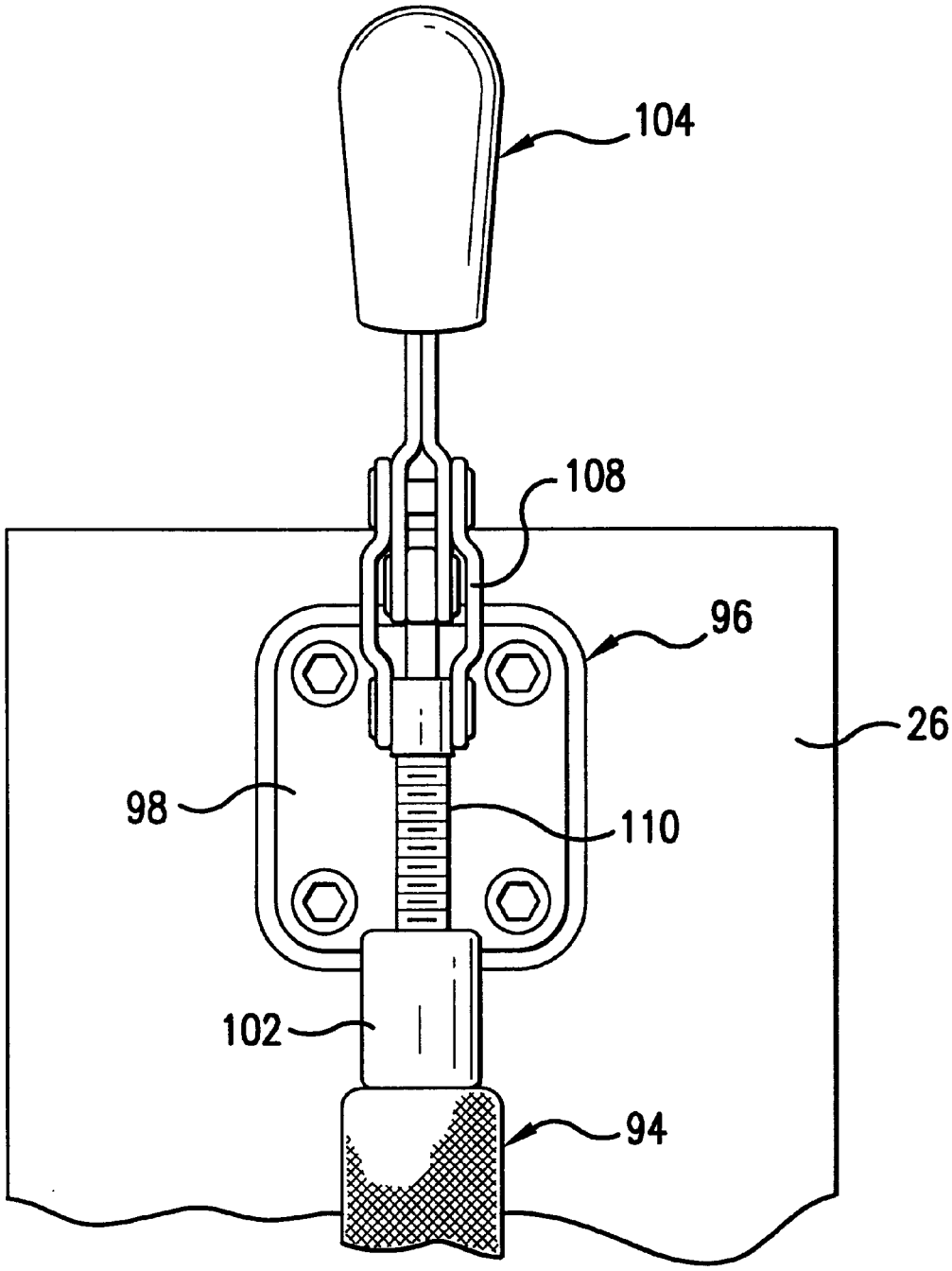
FIG. 6 is a front elevational view of the apparatus shown in FIG. 5 showing the handle in a raised position.

Referring now to the drawings, and especially to FIG. 1, a portable workpiece bending apparatus embodying the herein disclosed invention is generally identified by numeral 20. Apparatus 20 is supported on conventional support 22 which in this instance is a portion of a worktable or workbench.

Figure 11:
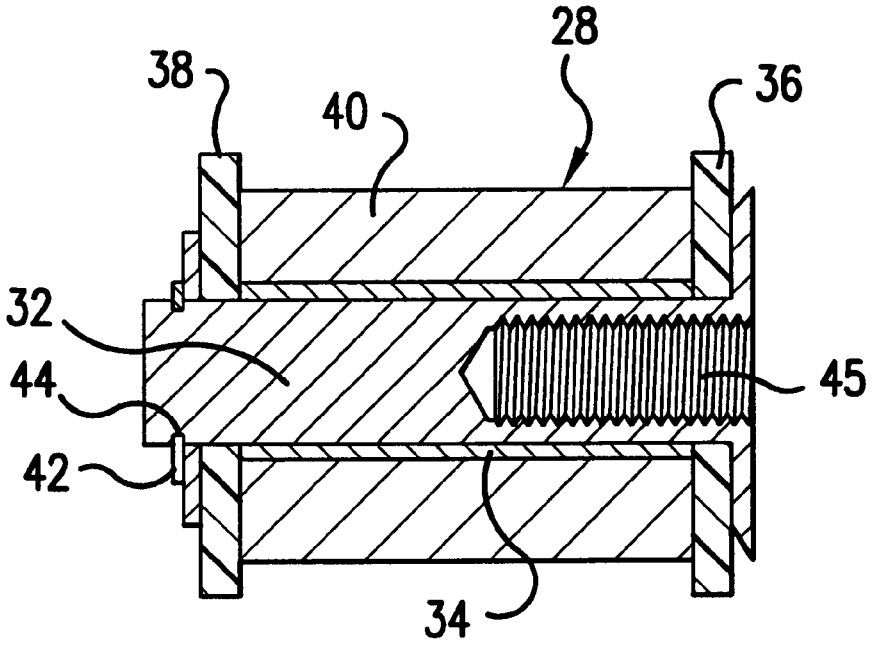
FIG. 11 is a cross sectional view of one of the idler rollers.

Apparatus 20 includes a frame 24 having a flat face 26, which is substantially vertical so that it is effectively perpendicular to support 22. A pair of identical idler rollers 28 and 30 is mounted on flat face 26. Each of the idler rollers 28 and 30 rotate on its own axis of rotation which axis is perpendicular to flat face 26. The construction of the idler rollers is identical. The construction of roller 28 is shown in FIG. 11. Roller 28 includes an axle 32 which has mounted thereon a sleeve 34. A pair of guide faces 36 and 38 are spaced apart by sleeve 34. A cylindrical work surface 40 is mounted on the sleeve 34. A lock ring 42 is mounted in a groove 44 to lock the sleeve, guide faces, and work surface 40 onto axle 32. Axle 32 includes an axial threaded aperture 45 to receive a fastener (not shown) for mounting the roller on face 26 so that the axle is perpendicular to the face. The roller rotates on an axis which is perpendicular to the face.

Idler rollers 28 and 30 are spaced apart to receive a drive or power roller 46 between them. The drive roller is rotatably mounted in a carriage 48 having its axis of rotation parallel to the axis of rotation of each of the idler rollers. Carriage 48 has a guide face 50 and a parallel drive face 52 connected by an integral clevis plate 54. The drive roller includes an axle 56 which has a guide face 58 mounted thereon and positioned in an aperture 60 in guide face 50. Power roller 46 also has a pair of guide faces 62 and 64 mounted on axle 56. A cylindrical work surface 66 is mounted on axle 56. Work surface 66 is secured to the axle. A drive bearing 68 is mounted on axle 56 and is rotatably mounted in an aperture 70 in drive face 52. A conventional handle 72 is mounted on one end of the axle and a lock ring 74 is mounted in a groove 76 at the other end of the axle to hold the axle and handle in position. Handle 72 includes a throw 74 with a conventional gripping portion 76 on the throw in order to rotate drive roller 46.

Face 26 includes an aperture 78 defined by a pair of integral guide edges 80. The guide face has a pair of opposed guide flanges 82 formed integral therewith in engagement with respective face guides 80, so that the flanges and guides 80 cooperate to act as a guide to limit movement of the carriage to a straight line movement and these limit movement of the drive roller to a straight line movement relative to the idler rollers.

The carriage has a pair of integral clevis ears 84 and 86 with a clevis pin 88 mounted in the ears. A clevis 90 is pivotedly mounted on the clevis pin. Clevis 90 is connected to a clevis rod 92 which is in turn connected to a turnbuckle nut 94 which is internally threaded to receive a threaded end of clevis rod 92.

An operator yoke 96 is secured to face 26 of the frame. The operator yoke includes a mounting base 98 with a mount 100 formed integral with the base. A rod sleeve 102 is also formed integral with mounting base 98, and sleeve 102 spaced from mount 100. A toggle handle 104 is pivotedly connected to mount 100 by a pivot pin 106, so that handle 104 pivots relative to the frame. A toggle link 108 is connected to handle 104 adjacent to one end. The other end of link 108 is connected to an actuator rod 110. Actuator rod 110 is slidably mounted in sleeve 102. The toggle handle operates the toggle in a conventional toggle fashion, wherein pivoting of handle 104 toward the face causes the link to raise rod 110 and with it carriage 48 to move drive roller 46 upward. The combination of the handle and rod 110 connected to carriage 48 is an actuator for moving drive roller 46. Pivoting of the handle downward causes the rod to move downward and with it drive roller 46.

Figure 7:
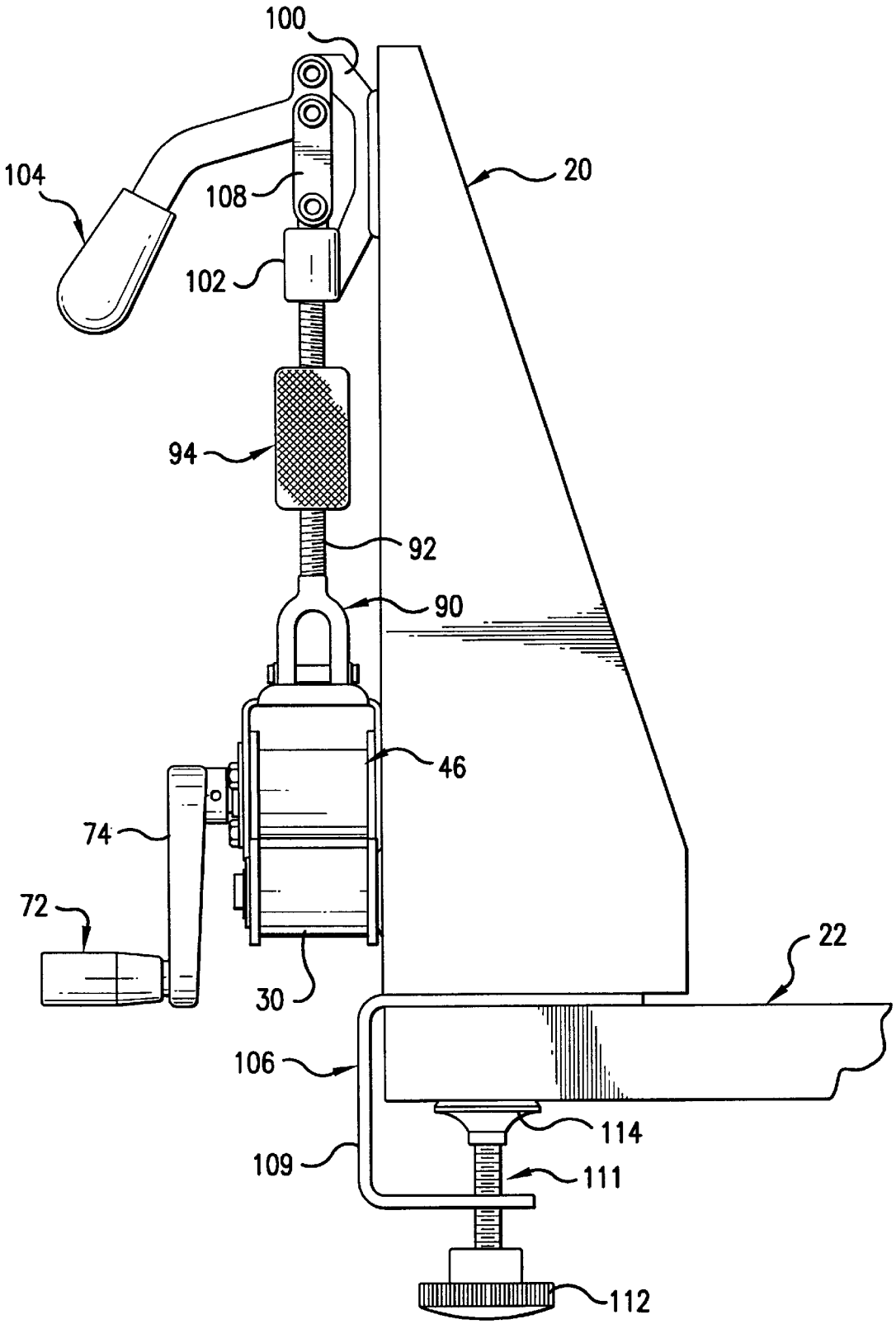
FIG. 7 is a side elevational view of the apparatus of FIG. 1 showing the apparatus secured to a supporting surface and the rollers in an operative position.
Figure 8:
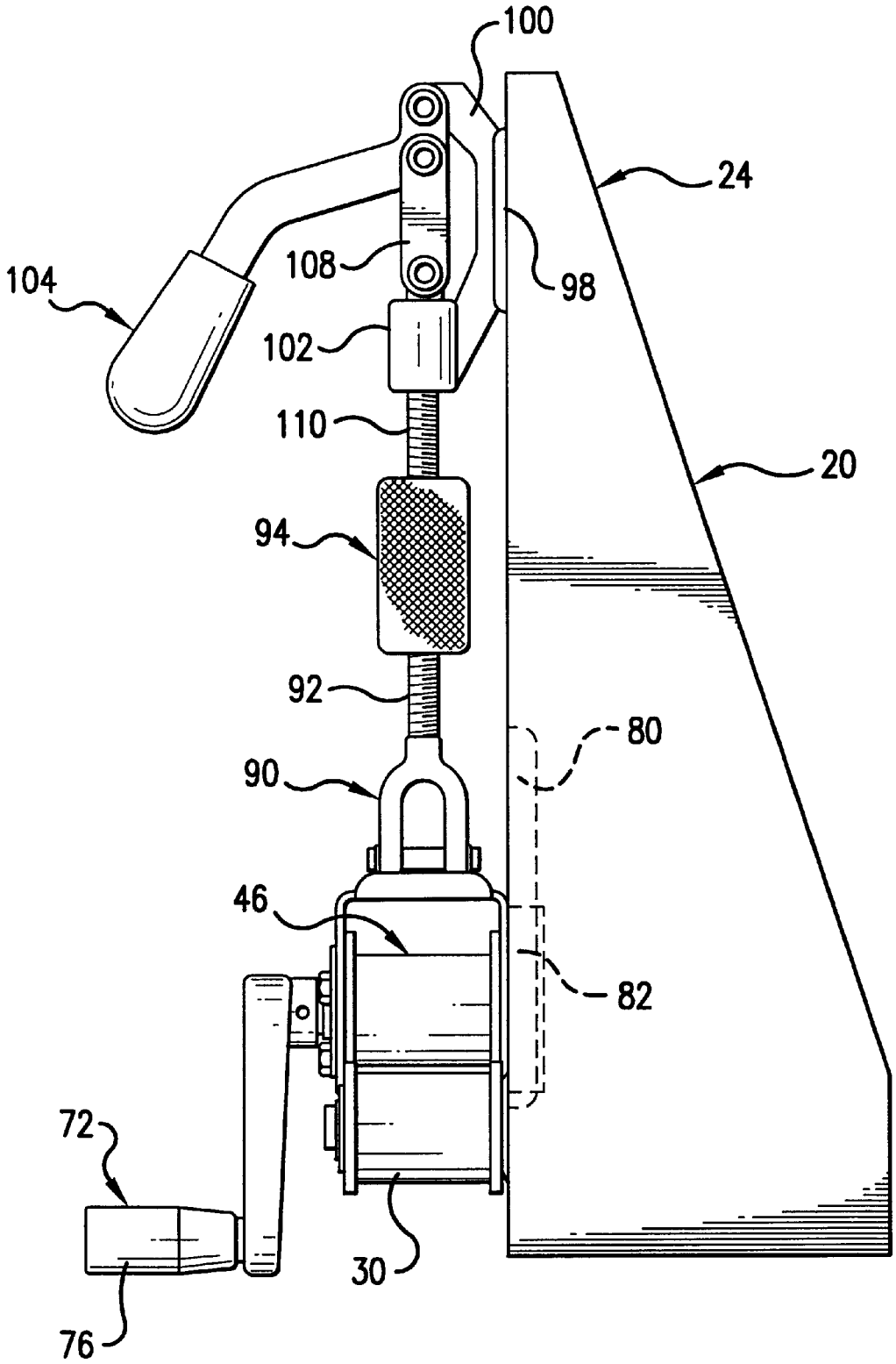
FIG. 8 is a side elevational view similar to FIG. 7, but showing a guide portion in phantom view.
Figure 9:
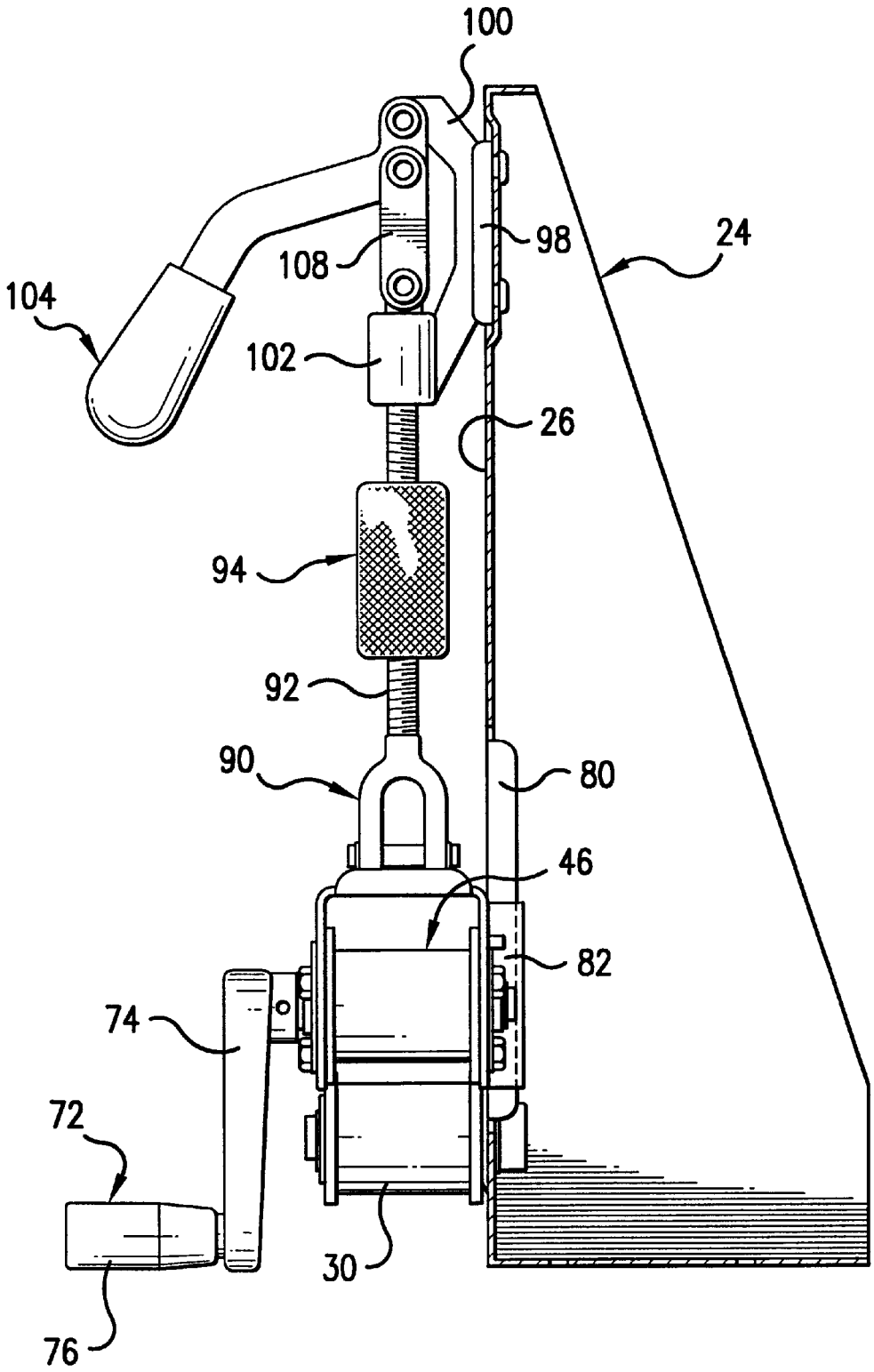
FIG. 9 is a cross sectional view similar to FIG. 8, but showing a guide apparatus.
Figure 10:
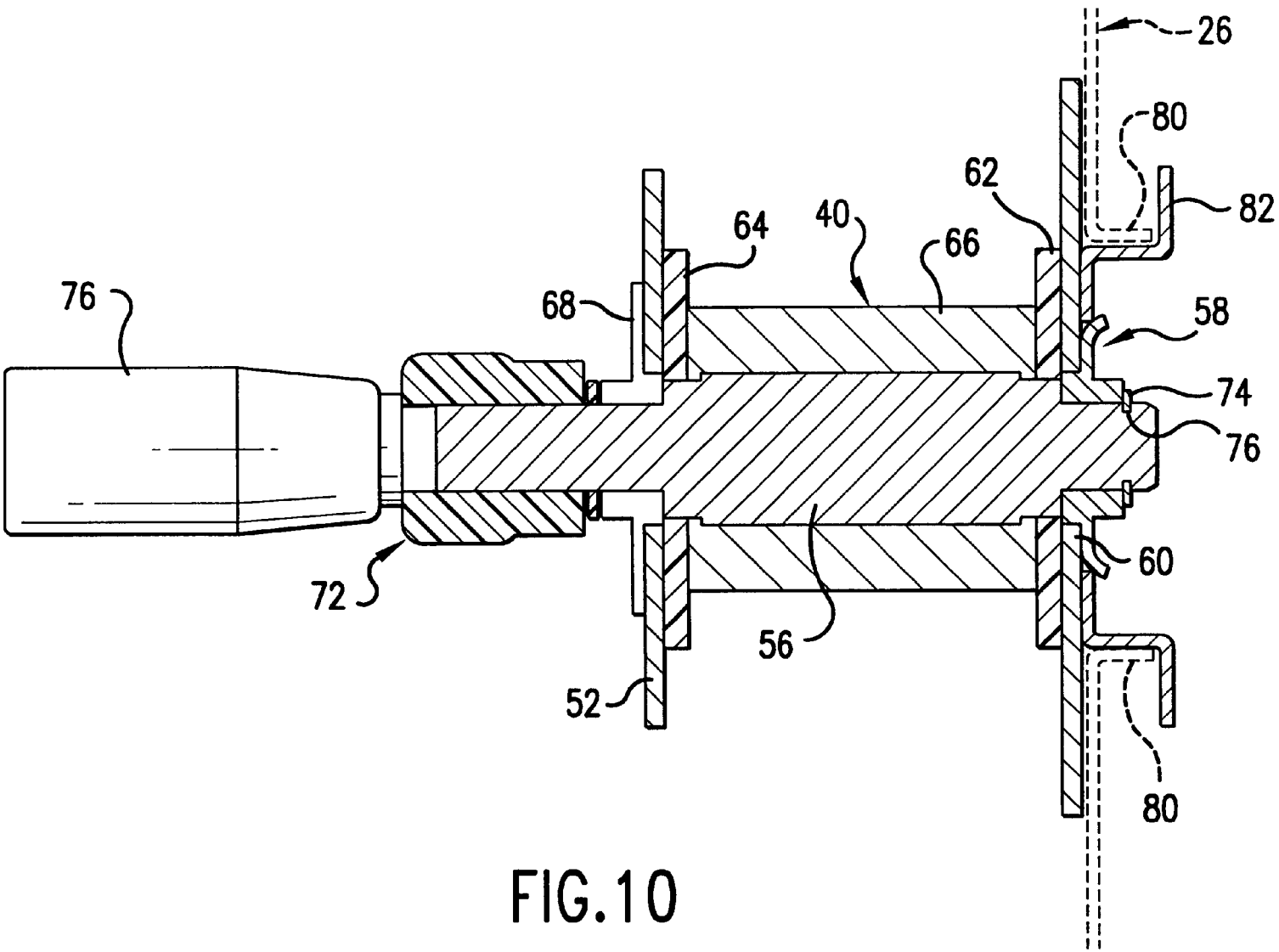
FIG. 10 is a cross sectional view of a power roller and handle.

The bending apparatus is lightweight and may be easily transported to a desired location. The bending apparatus is supported on a conventional surface 22 and is secured to that surface by a clamp 106. Clamp 106 includes a C-shaped member 109, which is fixed to frame 24. A conventional screw post 111 is threadedly mounted in the C-shaped member with a conventional knob 112 on one end. Turning the screw post causes movement of a pad 114, which is engageable with the underside of support 22, as may be seen in FIG. 7. Bending apparatus 20 may be easily mounted on or removed from support 22 by the operation of the screw post.

Once the bending apparatus is secured in place, it is ready to bend a workpiece 116 to a desired shape. The position of drive roller 46 relative to the idler rollers 28 and 30 is further determined. Turnbuckle 94 connected to the actuator and the drive roller is a locator used to determine the position of the drive roller in an operative position relative to the idler roller. Toggle handle 104 is raised to the attitude shown in FIG. 1 so that workpiece 116 in a horizontal attitude substantially parallel to support 22 may be inserted into an operative position on the idler rollers 28 and 30, which provide a horizontal support for the workpiece. Handle 104 is moved downward so that drive roller 46 engages workpiece 116. The position of the drive roller in its operative position relative to the idler rollers bends the workpiece from a horizontal straight line to determine the slope of the bend. Drive roller position in engagement with the workpiece relative to the idler rollers cause the workpiece to bend a selected amount. Handle 72 is rotated as a roller drive to rotate drive roller 46 to move the workpiece along its length. The amount of rotation of the drive roller determines the extent of the bend made in the workpiece. Movement of toggle handle 104 to the up position causes the drive roller to disengage the workpiece. The workpiece then may be removed to inspect the amount of the bend. In certain instances, the workpiece with the bend is placed in a desired location to determine whether the bend is proper. In the event that additional bending is necessary for a proper fit of the workpiece, the workpiece is re-inserted into an operative position onto the idler rollers by transaxial movement of the workpiece. The drive roller moved to the same position which it had prior to removal of the workpiece. The length of the bend may be increased by rotating of the handle. In the event that it is necessary to increase the slope of the bend, the turnbuckle may be adjusted to move the drive roller toward the idler rollers, so that the slope of the bend is increased. With the increase in the slope, the amount of the bend may be extended by rotating the drive roller, as may be necessary.

The instant bending apparatus allows a reverse bend to be made in the workpiece. Once an appropriate bend is made in the workpiece, the workpiece may be removed, as described above. The workpiece then may be inverted and again inserted into the bending apparatus to rest on idler rollers 28 and 30. Drive roller 46 is then moved down into engagement with the workpiece so that there is a bend in the workpiece which is reversed to the first bend. The length of the bend is determined by the amount of bending which is created by rotation of the drive roller.

Inasmuch as the workpiece is loaded and removed from the bending apparatus through a motion which is perpendicular to the length of the workpiece, the transaxial loading and unloading of the workpiece allows the workpiece to be inspected during the bending operation. Furthermore, the workpiece may be bent in a reversed direction relative to a first bend in the workpiece.

Although a specific embodiment of the herein disclosed invention has been disclosed in detail above, it is readily apparent that those skilled in the art may make various modifications and changes in an apparatus without departing from the spirit and scope of the present invention. It is to be expressly understood that the instant invention is limited only by the appended claims.

What is claimed is:

1. A portable workpiece bending apparatus for selectively bending an elongated workpiece at selected portions of the workpiece along its length and allowing transaxial loading and unloading of the workpiece comprising; a frame having a substantially flat face, a clamp connected to the frame for selectively securing the frame to a support with the face substantially perpendicular to the support, a pair of spaced apart idler rollers mounted on the flat face, each of said idler rollers rotating on a respective axis substantially perpendicular to the flat face to provide a horizontal support, an operator yoke mounted on the flat face, said operator yoke having a rod sleeve, a handle pivotedly connected to the operator yoke and spaced from the rod sleeve, a toggle connected to the handle, an actuator rod slidably mounted in the rod sleeve and having one end connected to the toggle for longitudinal movement of the actuator rod along its length, a turnbuckle nut threadedly connected to the actuator rod, a clevis rod threadedly connected to the turnbuckle nut, a clevis connected to the clevis rod, a carrier pivotedly connected to the clevis, a guide aperture in the flat face of the frame, a guide mounted on the carrier and positioned in the guide aperture to limit movement of the carrier to a straight line motion, a drive roller rotatably mounted on the carrier, said drive roller having its axis of rotation parallel to the axis of rotation of each of the idler rollers, a crank connected to the drive roller for selectively rotating the drive roller, whereby positioning of the drive roller between the spaced idler rollers bends a workpiece in engagement with the idler rollers and the drive roller, rotation of the drive roller bends the workpiece at a selected portion of the workpiece through operation of the handle, and the toggle selectively moves the carriage with the drive roller relative to the idler rollers to allow transaxial loading and unloading of the elongated workpiece.

* * * * *